US009339439B2

(12) United States Patent
Nudo

(10) Patent No.: US 9,339,439 B2
(45) Date of Patent: May 17, 2016

(54) PHARMACEUTICAL CONTAINER SYSTEM

(71) Applicant: P. J. Nudo, Ramona, CA (US)

(72) Inventor: P. J. Nudo, Ramona, CA (US)

( * ) Notice: Subject to any disclaimer, the term of this patent is extended or adjusted under 35 U.S.C. 154(b) by 4 days.

(21) Appl. No.: 14/015,351

(22) Filed: Aug. 30, 2013

(65) Prior Publication Data

US 2015/0027913 A1 Jan. 29, 2015

Related U.S. Application Data

(60) Provisional application No. 61/698,151, filed on Sep. 7, 2012.

(51) Int. Cl.
*B65D 25/08* (2006.01)
*A61J 1/20* (2006.01)
*B65D 81/32* (2006.01)

(52) U.S. Cl.
CPC ..... *A61J 1/2089* (2013.01); *B65D 81/3211* (2013.01); *A61J 1/202* (2015.05); *A61J 1/2027* (2015.05); *A61J 2001/2027* (2013.01); *Y10T 137/9029* (2015.04)

(58) Field of Classification Search
CPC ..... B65D 71/502; A61J 1/2089; A61J 1/202; A61J 1/2027
USPC ..... 206/219–222, 568; 215/6, 10, DIG. 8; 222/61, 142.5
See application file for complete search history.

(56) References Cited

U.S. PATENT DOCUMENTS 4,103,772 A 8/1978 Wiegner
4,634,013 A 1/1987 Bar-Kokhba
4,664,276 A 5/1987 Taragna et al.
4,709,822 A 12/1987 Vataru
5,007,546 A 4/1991 Rose et al.
5,090,582 A 2/1992 Art et al.
5,277,303 A * 1/1994 Goyet ..... B65D 81/3211 206/219
5,307,943 A 5/1994 Iidaka
5,647,481 A * 7/1997 Hundertmark ..... B65D 81/3211 206/219
5,709,311 A 1/1998 Butler et al.
6,135,275 A * 10/2000 Kelders ..... B65D 81/3211 206/219
6,244,433 B1 * 6/2001 Vieu ..... B65D 81/3211 206/221
6,247,586 B1 * 6/2001 Herzog ..... B65D 81/3211 206/221
6,321,908 B1 * 11/2001 Lorscheidt ..... B65D 81/3211 206/221
8,172,102 B2 5/2012 Hidding
2007/0039975 A1 * 2/2007 Bochtler ..... B65D 81/3211 222/142.5
2008/0142030 A1 * 6/2008 Venere ..... A45D 19/0008 132/116
2009/0216213 A1 * 8/2009 Muir ..... B01L 3/502 604/414
2013/0334078 A1 * 12/2013 Ariagno ..... A61J 1/2089 206/219

* cited by examiner

*Primary Examiner* — Luan K Bui
(74) *Attorney, Agent, or Firm* — Mark Wisnosky

(57) ABSTRACT

A pharmaceutical container comprising a pair of containers interconnected with a coupling is described. The containers are intended to contain two components of a pharmaceutical such that when mixed a finished, ready to use, pharmaceutical mixture results. The coupling includes cutting devices that can cut through a frangible membrane when the containers, joined by the coupling are twisted with respect to one another.

4 Claims, 8 Drawing Sheets

PHARMACEUTICAL CONTAINER SYSTEM

CROSS-REFERENCE TO RELATED APPLICATIONS

This application claims priority to the U.S. Provisional Application 61/698,151, titled: Pharmaceutical Container System, filed Sep. 7, 2012, by the same inventor.

BACKGROUND OF THE INVENTION

1. Technical Field

The present invention relates to containers for pharmaceutical materials, particularly for a powdered pharmaceutical that must be reconstituted by thorough mixing with a specific quantity of a diluent prior to administering it.

2. Related Background Art

Reconstitution of powdered pharmaceuticals is a daily task in most pharmacies. Patients who have difficulty swallowing medication in the form of a capsule or tablet benefit from the availability of the medication in a liquid suspension. Such prescriptions are ordered by physicians with instructions to reconstitute a prescribed strength of powdered pharmaceutical with a prescribed volume of diluent, typically water. In the pharmacy, glass or plastic graduated cylinders are used to manually measure the diluent that is gradually added to the powdered pharmaceutical. In many pharmacies, the reconstitution is accomplished manually by measuring the diluent from a presumably sterile internal source using conventional lab ware, then adding the liquid to the container containing the powdered pharmaceutical and mixing the suspension by shaking the container.

Commercial reconstitution devices are available. These devices consist of a diluent storage unit that holds 1-5 gallons of water and is usually placed on a high shelf. The diluent is gravity fed through a computer-controlled valving system driven by a scanned bar code or other identification means to the container containing the powdered pharmaceutical. The diluent is added in two or more portions to allow prewetting of the dry powder to avoid the formation of unsuspended clumps of powder.

Even when using the latest automated systems, accuracy and sterility can be issues. A better solution is to provide the diluent as a premeasured, prepackaged sterile component that can then be mixed with the powdered pharmaceutical through an integrated packaging system that maintains accuracy and sterility.

Multiple compartment containers that allow mixing of components stored separately in each compartment upon tearing or bursting a frangible membrane are known in the art. Such containers have been developed for the delivery of flavored beverages or other food products, and for the preparation of sterile medical products wherein the product has a limited lifetime in mixed form, but much longer shelf life when stored as separate components. In the case of retail pharmaceuticals, it is preferred that the mixing process be accomplished by trained individuals to ensure that a mixture of adequate uniformity and potency is delivered to the patient. Furthermore, it is preferred that the packaging be capable of delivering the diluent to the powdered pharmaceutical in two or more portions to allow prewetting, as described above. The multiple compartment containers known in the art do not generally support these preferences.

There is a need for a new means to mix pharmaceuticals that provides for pre-measured sterile components and allows pre-wetting of dry components.

DISCLOSURE OF THE INVENTION

A container system for reconstituting powdered pharmaceuticals is described that allows prepackaged quantities of diluent in a sterile container to be safely stored and delivered to a separate container of powdered pharmaceutical in multiple portions. The separate diluent and powdered pharmaceutical containers are interconnected by a coupling that includes a frangible interface that provides sterile sealing of the individual containers prior to mixing and allows the diluent to be added in portions. The diluent container and the coupling are discarded after mixing, and a separate cap is applied to the container containing the mixture to complete the deliverable pharmaceutical configuration. A cutter assembly is incorporated into the coupling such that upon twisting the containers relative to one another the cutter engages the frangible membrane and cuts the membrane to provide a path to mix the contents of the two interconnected containers. In the preferred embodiment the cutter assembly is designed to cut slots in the frangible membrane such that mixing can be accomplished in stages such that a dry component in the one container can be pre-wet prior to addition of the full amount of the diluent. This process has been found to avoid clumping of the dry material and provides a more uniform mixing.

One embodiment includes the diluent container and the coupling suitably modified to provide sterile attachment to a standard pharmaceutical container such as used for delivery and storage of powdered pharmaceuticals that require reconstitution.

Another embodiment is a method of distributing powdered pharmaceuticals that must be reconstituted before use, in which the powdered pharmaceutical and the intended diluent are provided in complementary sterile packages that facilitate sterile, accurate reconstitution at the point of sale or use.

Yet another embodiment is a method of reconstituting powdered pharmaceuticals in which the powdered pharmaceutical and the intended diluent are provided in complementary sterile packages that facilitate sterile, accurate reconstitution at the point of sale or use.

DETAILED DESCRIPTION

Figure 1:
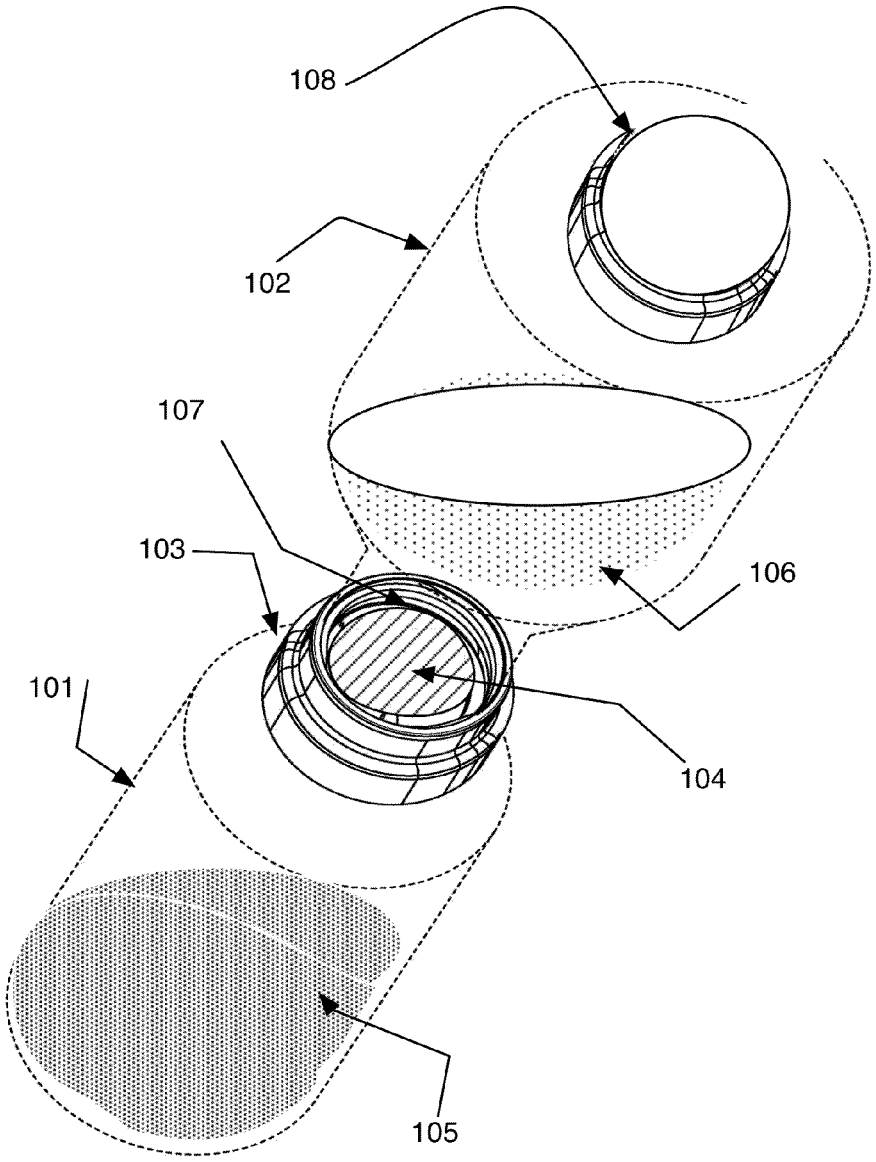
FIG. 1 shows a perspective view of the elements of the container system.

Referring now to FIG. 1, a first container 101 contains a first component 105 a two part pharmaceutical preparation. A second container 102 contains a second component 106 of the pharmaceutical preparation. The containers have threaded necks at the top to engage a cap-shaped connector 103. The walls of the connector 103 includes threads 107 that mate with threads on the containers' necks (threads on containers not shown) such that the containers can each be screwed into the connector thereby forming a closed system. The two containers are separated by a frangible membrane 104 that is attached two the second container and when screwed together is located inside the connector and forms a seal between the two containers. On first connection the membrane is intact and the pharmaceutical components 105, 106 are prevented from inter-mixing by the membrane 104. The containers may be made of any material commonly used for pharmaceutical containers. Non-limiting examples include glass and plastics. The pharmaceutical components may be liquids or solids. In a preferred embodiment one of the components 106 is a liquid to be used as a diluent of the second component 105 and the second component is a powder. In a preferred embodiment the container 102 that contains the liquid component is made of a plastic material that is deformable with hand pressure such that when squeezed the contents 106 are forced through slits cut into the frangible membrane using device and processes shown in later figures. A secondary cap 108 is detachably attached to the container 102 such that after mixing of the components in the container 101, the coupling 103 and container 102 are removed from the top of container 101 and replaced with secondary cap 108 to seal the reconstituted pharmaceutical mixture.

Figure 2:
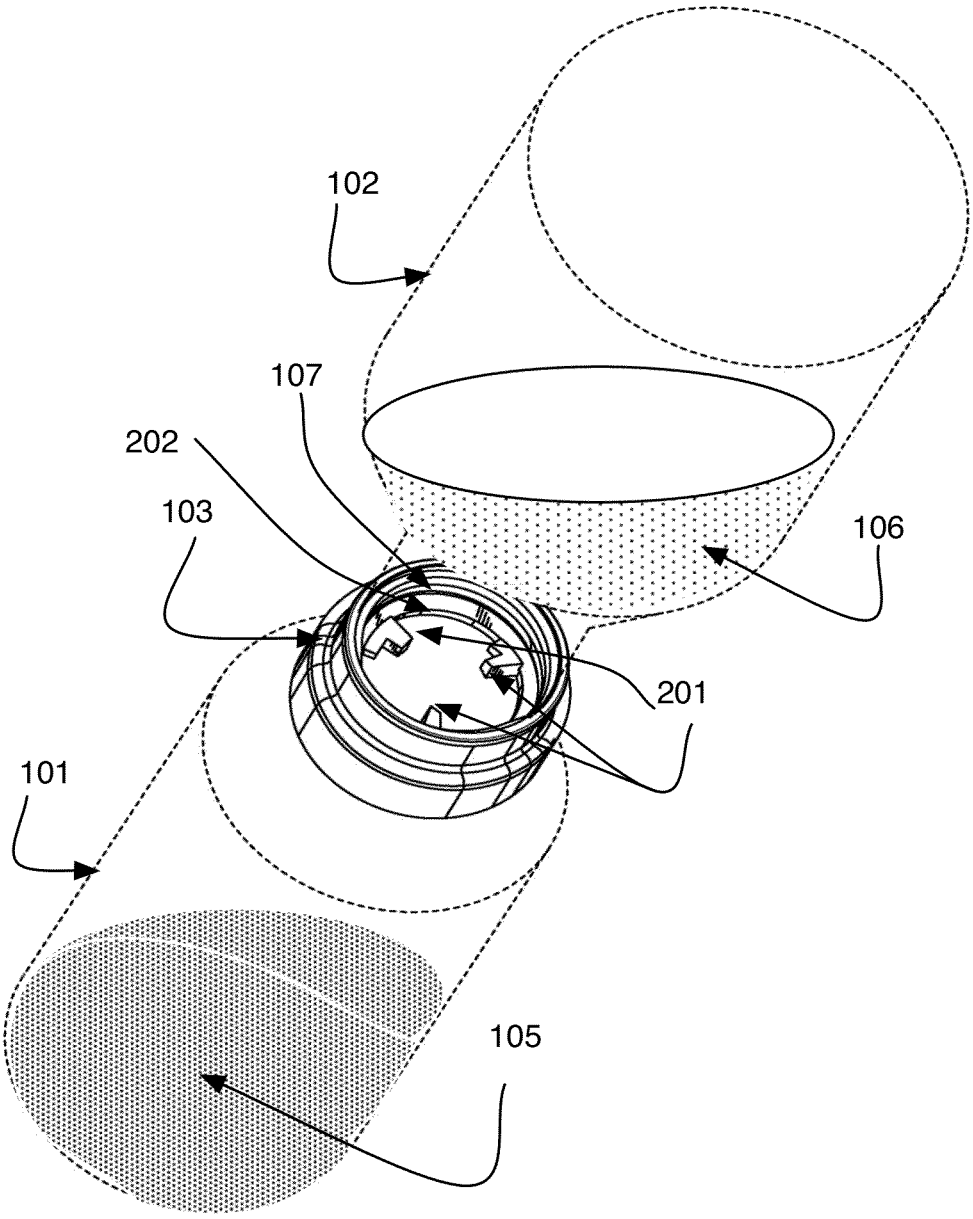
FIG. 2 shows a second perspective view with a frangible seal removed to see cutter assembly components.

FIG. 2 shows the same components as FIG. 1 except that the frangible membrane 104 has been removed to show cutting devices 201. The connector 103 includes cutting devices 201. In the example shown three cutting devices are used. The number of cutting device may be varied from at least 1 to 4 or more. The number of cutting devices is selected to optimize the rate of flow of component 106 into the lower container 101 once the frangible membrane is cut by the cutting devices. In use the membrane 104 is on place between the containers and the containers are attached to one another by screwing the tops into the connector 103. The first container is screwed completely into the coupler stopping at the flat at the bottom of ridge 202. The second container 106 is sealed with the frangible membrane 104 and is screwed into threads 107 to the point of just short of contact of the membrane with the cutting devices 201.

Figure 3:
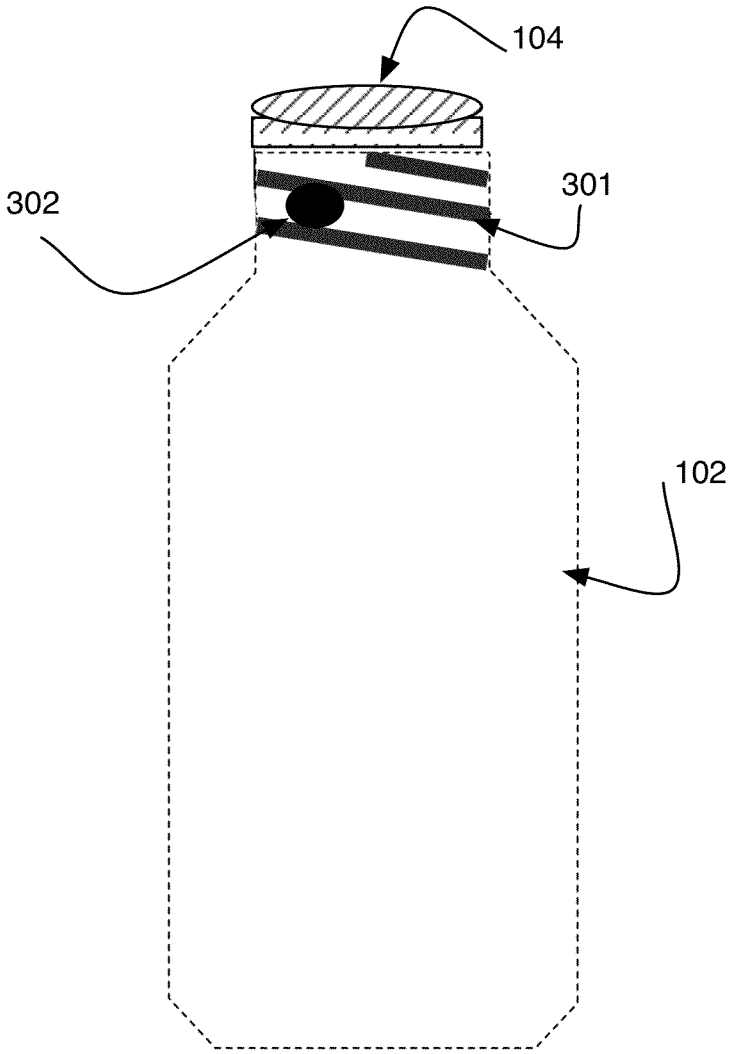
FIG. 3 shows a side view of a container component of the invention.
Figure 4:
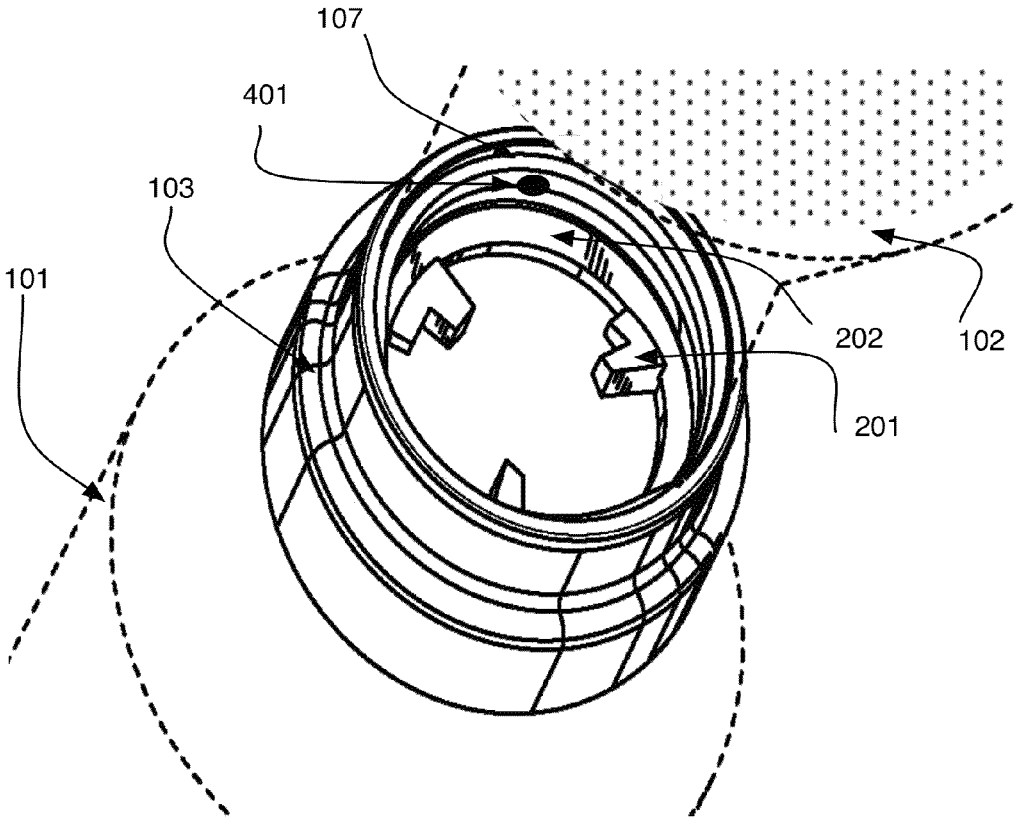
FIG. 4 shows a more detailed view of a connector component of the invention.

Referring to FIG. 3, in one embodiment the stopping point is determined by a stop 302 included in the threads 301 of the container 102. The location of the stop is selected such that the container is sufficiently threaded into the connector to from a sealed system. The location of the stop is a function of the size of the connectors, the size and angle of the threads and the size of the cutting devices. Also shown in FIG. 3 the frangible membrane 104 is seen to be sealed to the top of the container 102. Attachment of the frangible membrane is done using known techniques of adhesive or thermally welded seals. In a second embodiment shown in FIG. 4, the stop 401 is incorporated in the threads 107 of the connector 103. The figure also gives a more detailed view of the ridge 202 and the cutting devices 201.

Figure 5:
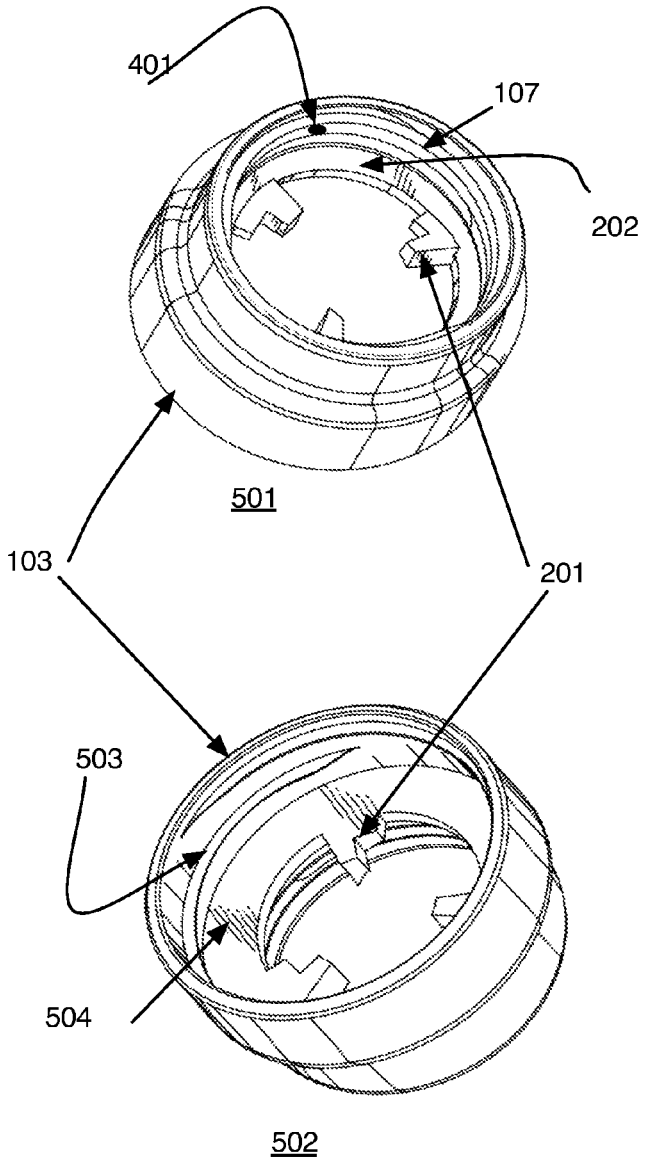
FIG. 5 shows top and bottom views of the connector component of FIG. 4.

Referring now to FIG. 5, top 501 and bottom 502 views of the connector 103 are shown. In the bottom view 502, the connector is seen to include threads to engage with threads on the container 101 see in previous drawings. The container is screwed into the coupling until the top of the container meets the flat surface 504 of the ridge 202. In the top view 501 the coupling is seen to include the top cutting surfaces of the cutting devices 201 and the ridge 202. The threads 107 engage the second container 102 shown and discussed in previous drawings. The embodiment shown includes the stop 401 that prevents the cutting devices 201 from engaging the frangible membrane when the container is first screwed into the connector.

Referring to this FIG. 5 and previous drawings, in use, the first and second containers are screwed into the coupling such that the first container 101 is sealed against the flat 504 and the second container 102 engages sufficient threads 107 to seal form a seal for the container 101. The second container at this point has an intact frangible seal affixed to the mouth of the container. Containers include the pharmaceutical components 105, 106. The complete filled and sealed system is then ready for shipment to the pharmacy or other dispensing location. To mix the components the second container is further tightened into the coupling forcing the mouth of the container past the stop 401 and as the container is screwed into the coupling the cutting devices 201 engage the frangible seal 104 and slits are cut into the frangible seal thereby providing a passage for the pharmaceutical component 106 to flow into the first container 101 and mix with component 105. The container 102 can be screwed further in beyond the stop 401 in increments to cut incrementally larger slits in the frangible membrane to control the flow of component from container 102 into container 101.

Figure 6:
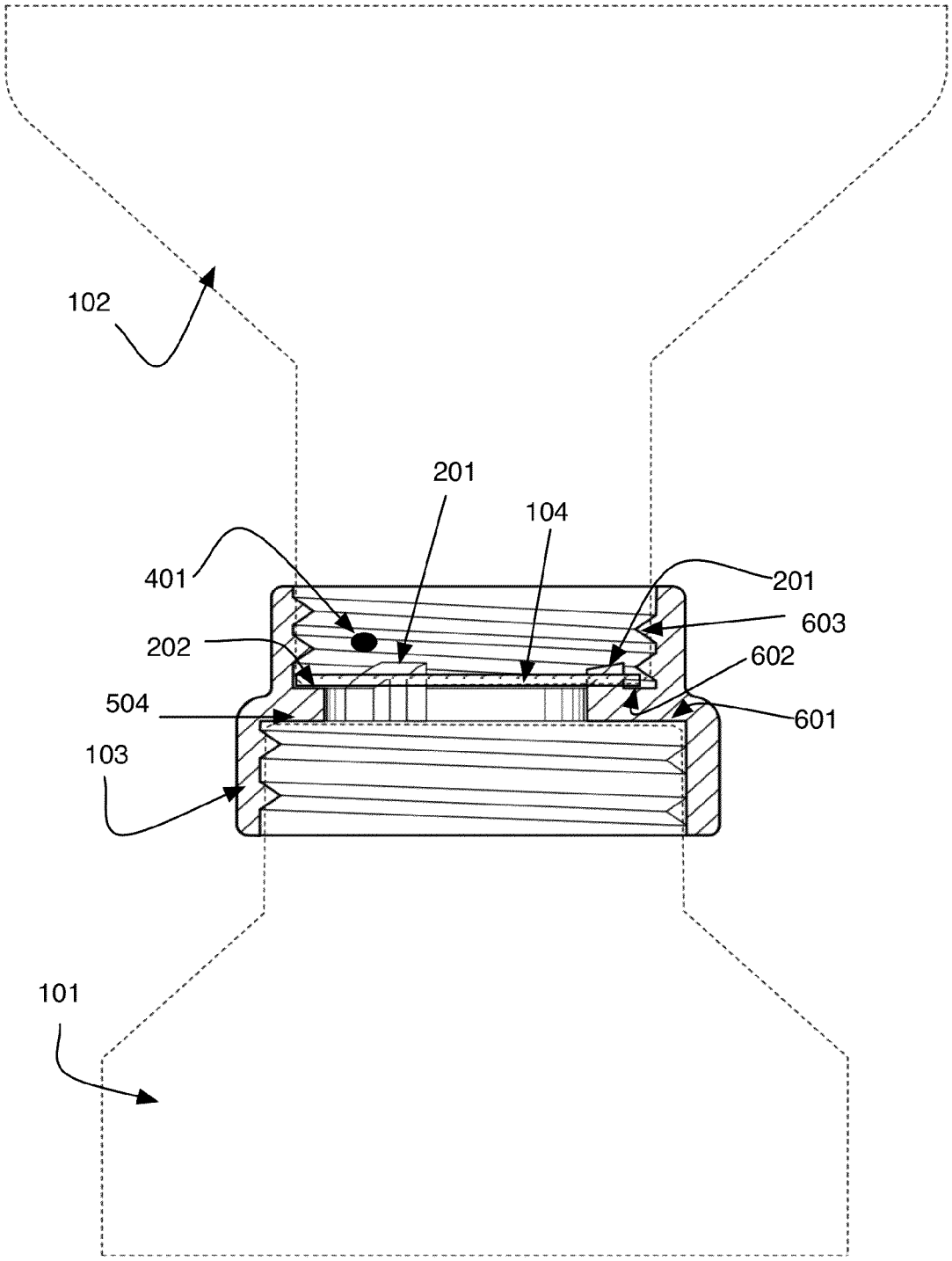
FIG. 6 shows a cross-sectional view of the connector component.

The components and process are further seen in FIG. 6. Here the containers 101 and 102 are fully engaged into the coupling 103. The top lip 601 of container 101 is engaged with the flat surface 504 and the lip 602 of container 102 with frangible seal 104 is now fully screwed in past the stop 401 such that contact is made with surface 202. The cutting devices 201 are seen to have now pierced the frangible membrane 104. The rate of piercing of the frangible membrane by the cutting device is determined by the dimensions of the cutting device (discussed in FIG. 7) and the number of threads 603 in the coupling device on the same side as the cutting device. Approximately two of threads are seen in the coupling device shown in FIG. 6. A higher thread count would result in more gradual piercing of the frangible membrane by the cutting device and may be required where finer control of the cutting is required or where there is a tougher membrane and it is necessary to make use of the mechanical advantage of the screw. In the preferred embodiment as shown there are approximately 5 threads per inch in the coupling.

To summarize an embodiment of a process to use the devices described herein: pharmaceutical component 105 is added to container 101 and connector 103 is attached to the top of the container. Pharmaceutical component 106 is added to container 102 and the top of the container is sealed with a frangible membrane 104. In the preferred embodiment component 105 is a powdered pharmaceutical component and component 106 is a sterile water component. The amounts of components 105 and 106 are measured such that when mixed the resulting mixture will represent the reconstituted pharmaceutical at the appropriate concentration for use. Container 102 is then screwed into coupling 103 such that the lip of the container 601 reaches just to but not beyond the stop 401 such that the frangible membrane remains intact for shipping. The previous steps typically are completed at the place of manufacture of the pharmaceuticals. The filled coupled containers are then packaged and shipped to the pharmacy for sale and dispensing. At the pharmacy or at the consumer, the container 102 is further rotated relative to coupling 103 such that the lip of the container 601 moves past the stop 401 causing the cutting devices 201 to pierce the frangible membrane 104 to allow mixing of the components contained with the containers 101, 102. In one embodiment mixing is facilitated by making the container 102 of a material that is deformable by hand pressure thereby forcing the contents of container 102 through the cut slit into container 101. Once fully mixed the coupling 103 and container 102 is unscrewed from container 101 and replaced with secondary cap 108 such that the now reconstituted pharmaceutical mixture can be dispensed.

Figure 7:
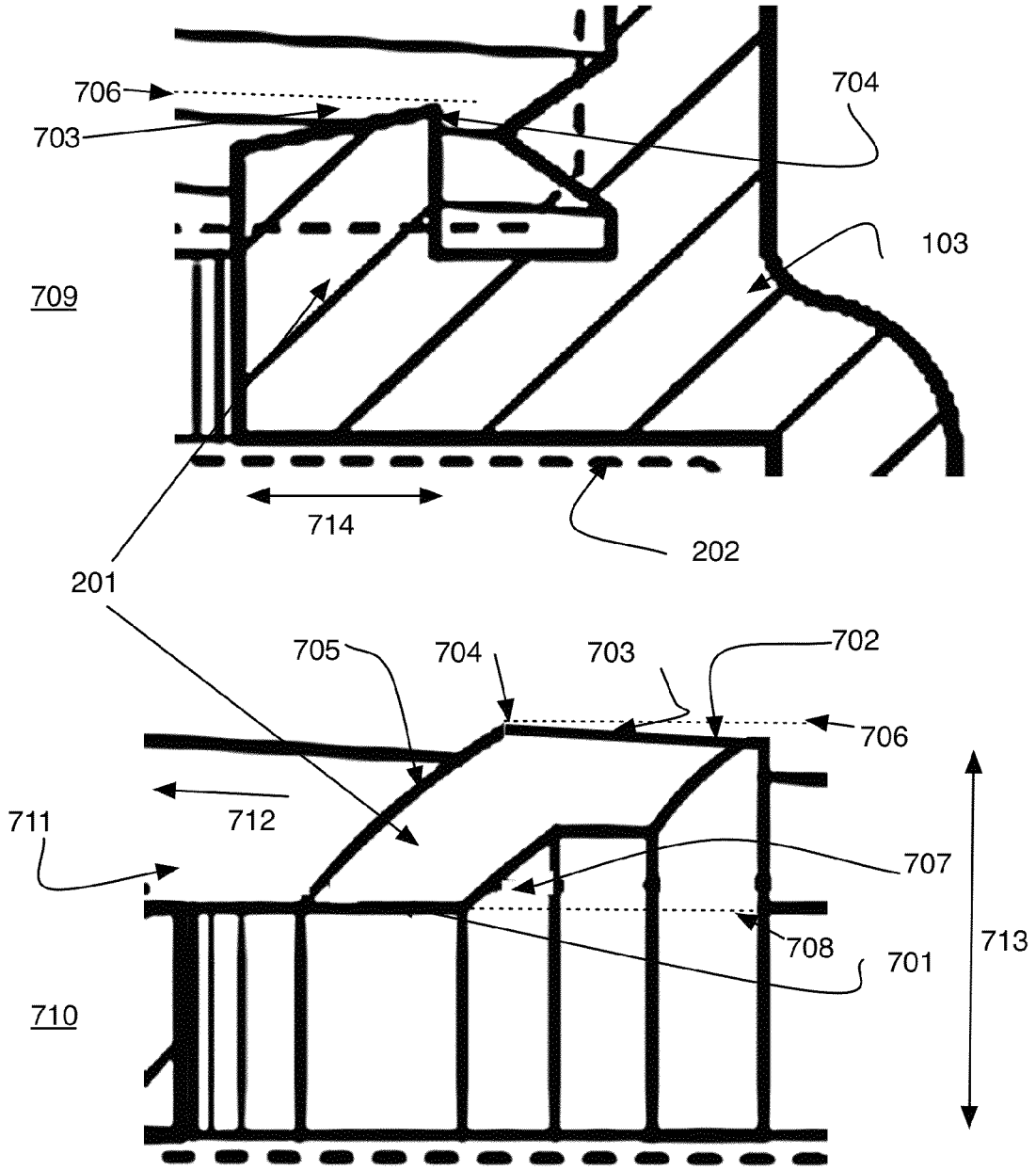
FIG. 7 shows a cross section and detail view of the cutter assembly.

Referring now to FIG. 7, details of the cutting device 201 are seen. View 709 shows a cross section of the coupling 103 including a cross-section of the cutting device 201. View 710 shows a view of the cutting device as it would be seen from the interior of the coupling 103. The cutting device is seen as a curved L-shaped structure attached to the wall of the coupling 103. Wherein the long edge of the L is nearer the wall of the coupling and curved the same as the wall of the coupling. In the preferred embodiment the coupling is molded from a thermoplastic material and the cutting device(s) are molded as part of the coupling at the time of manufacture. The top of the structure is sloped from a base 701 to a top edge 702. The base 701 is located at the top of the "L" and top edge is the base of the "L". The slope angle 707 is defined as the angle from a horizontal line 708 of the edge 705. The top edge 702 is also sloped downward from a horizontal line 706 forming an angle 703 with the horizontal. Horizontal is defined as perpendicular to the vertical wall 711 of the coupling device 103. The sloping of the edge 702 results in a first point of contact 704 where when the containers are screwed together beyond the stop (discussed earlier) the point 704 first pierces the frangible membrane. Further turning in the direction 712 results in the coupling 103 and the cutting device 201 being moved in the direction 712 and vertically such that the edges 705 and 702 further pierce the membrane thereby cutting a slot in the membrane. The height 713 of the cutting device determines how far into the frangible membrane the cutting device will pierce as the container 102 is screwed down to surface 202.

The dimensions for the cutting device are determined empirically and are optimized for parameters such as: the toughness of the frangible membrane, the viscosity of the liquid component contained in container 102, the control required for allowing fluid to flow from container 102 to container 101 and other. For example a higher viscosity component in container 101 would require a larger slit to be cut in the membrane to allow fluid flow. In Such a case the height of the cutting device would be made larger and the angle 707 would also be made larger. The number of threads per inch on the coupling device 103 may be optimized for the toughness of the frangible membrane. If in the example of a higher viscosity component the cutting device is designed to make a larger cut in the membrane or the membrane is made of a tougher material, it could require a higher thread count to enable the user to easily turn container 102 relative to the coupling 103. A narrower slit is made if the angle 703 is made larger such point 704 of the cutting device is sharper. A narrower slit may be required for a less viscous component contained in container 102.

Figure 8:
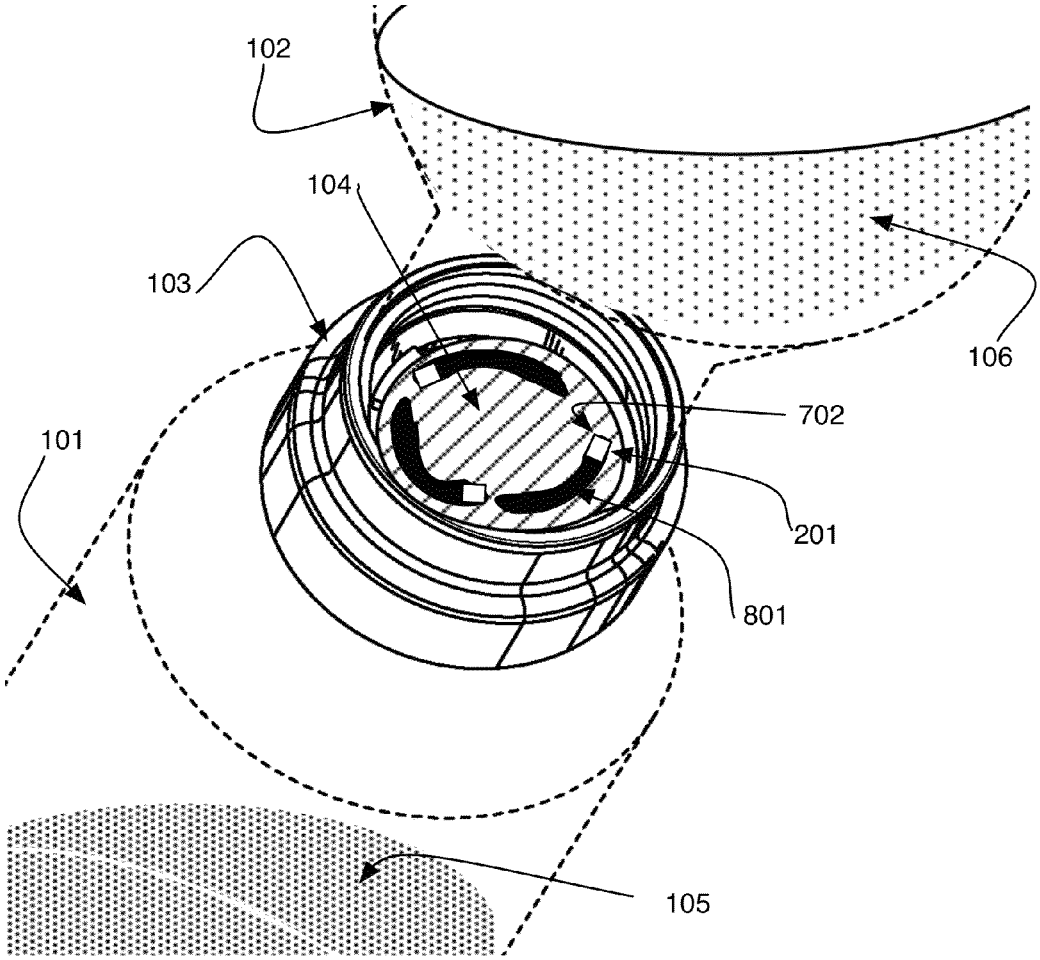
FIG. 8 shows a view of the seal with slots cut into the seal for mixing.

Finally in FIG. 8 a container system in which the membrane 104 has been cut producing slits 801. The containers 101, 102 have been twisted with respect to one another and with the coupling device 103 such that the cutting devices 201 have cut slits 801 into the membrane 104. The component 106 can then flow through the slits and into container 101 to mix with component 105.

SUMMARY

A pharmaceutical container comprising a pair of containers interconnected with a coupling is described. The containers are intended to contain two components of a pharmaceutical such that when mixed a finished, ready to use, pharmaceutical mixture results. The coupling includes cutting devices that can cut through a frangible membrane when the containers, joined by the coupling are twisted with respect to one another.

Although described as a pharmaceutical container, those skilled in the art could see that the container system could be used for any two-component system wherein the components are intended to be kept separate until the time of use.

I claim:

1. A pharmaceutical container system comprising:

a) a first container, said container having a threaded neck, b) a second container, said second container having a threaded neck and sealed with a frangible membrane, c) a cap shaped connector, said connector being cylindrical with an opening at each end to engage the first and second containers, and, having an inside wall, and, comprising threads on the inside wall to engage the threads on the containers, wherein the threads that engage the second container include a stop, and, said cap shaped connector further including at least one cutting device, d) said cutting device comprising a curved L-shaped protrusion molded on the inside wall of the connector, said protrusion having a height, a long edge, a short edge, a top edge and a base wherein:

i) the long edge and the short edge are joined perpendicularly to form a letter L, and, ii) the long edge of the L-shaped protrusion is positioned horizontally along the inside wall of the connector, where horizontal is defined as a plane parallel to the opening of the cap shaped connector, and, iii) the top edge is higher than the base, where higher means closer to a point of contact of the cutting device to the frangible membrane, and, thereby the long edge of the L-shaped protrusion forms an angle with a horizontal plane, and, e) the base is slanted at an angle down from horizontal such that the point of connection of the base and the long edge of the L-shaped protrusion forms a cutting point, wherein down means further away from the point of contact of the cutting device to the frangible membrane, and, whereby when the second container is screwed into the connector to the stop, and the first container is screwed into the opposite side of the connector, the two containers and the connector form a closed system, where the contents of the containers are isolated from the environment outside of the containers and also isolated from each other, and, f) and when the second container is screwed into the connector beyond the stop the cutting point of the cutting device pierces the frangible membrane, and, as the container is further rotated, the long edge, and, the top edge of the L-shaped protrusion cut a slot in the frangible membrane, said slot having a width and a length.

2. The pharmaceutical container system of claim 1 wherein the first container contains a dry component of a pharmaceutical product and the second container contains a wet component of a pharmaceutical product and when the second container is rotated thereby cutting the slot in the frangible membrane the wet component flows from the second container into the first container.

3. The pharmaceutical container system of claim 1 wherein the second container can be deformed by squeezing such that after the cutting device has cut the slot in the frangible membrane squeezing the second container increases the pressure within the container thereby increasing the flow of the contents of the second container into the first container.

4. The pharmaceutical container system of claim 1 wherein the angle of the long edge from horizontal, and the angle of the base from horizontal, and, the height of the cutting device are selected to adjust the width and length of the slot that is cut in the frangible membrane when the second container is screwed beyond the stop.

* * * * *